US008214957B2

(12) United States Patent
Miettinen

(10) Patent No.: US 8,214,957 B2
(45) Date of Patent: Jul. 10, 2012

(54) BRIDGE AND METHOD FOR MANUFACTURING THE BRIDGE

(76) Inventor: Ensio Johannes Miettinen, Espoo (FI)

( * ) Notice: Subject to any disclaimer, the term of this patent is extended or adjusted under 35 U.S.C. 154(b) by 482 days.

(21) Appl. No.: 12/304,727

(22) PCT Filed: Jun. 20, 2006

(86) PCT No.: PCT/FI2006/000218

§ 371 (c)(1),
(2), (4) Date: Nov. 17, 2009

(87) PCT Pub. No.: WO2007/147925

PCT Pub. Date: Dec. 27, 2007

(65) Prior Publication Data

US 2010/0139016 A1 Jun. 10, 2010

(51) Int. Cl.
*E01D 21/00* (2006.01)

(52) U.S. Cl. ..... 14/77.1; 14/3

(58) Field of Classification Search ..... 14/2, 3, 14/77.1, 78

See application file for complete search history.

(56) References Cited

U.S. PATENT DOCUMENTS

| | | | | |
|---|---|---|---|---|
| 108,663 | A * | 10/1870 | White | 14/3 |
| 1,800,819 | A * | 4/1931 | Donaldson | 405/139 |
| 3,688,327 | A * | 9/1972 | Marshall | 14/74.5 |
| 3,738,112 | A * | 6/1973 | Grant et al. | 405/136 |
| 3,808,624 | A | 5/1974 | Barkdull, Jr. | |
| 3,859,682 | A * | 1/1975 | Sulkiewicz | 14/3 |
| 4,454,620 | A * | 6/1984 | Barkdull, Jr. | 14/20 |
| 4,704,754 | A * | 11/1987 | Bonasso | 14/20 |
| 5,671,681 | A * | 9/1997 | Senior, III | 104/138.1 |
| 5,680,664 | A * | 10/1997 | Head | 14/4 |
| 6,012,191 | A * | 1/2000 | Caldwell | 14/18 |
| 6,684,793 | B2 * | 2/2004 | Dutoit | 104/124 |
| 2011/0047722 | A1 * | 3/2011 | Meheen | 14/4 |

FOREIGN PATENT DOCUMENTS

| | | |
|---|---|---|
| GB | 1398936 | 6/1975 |
| WO | 9006401 | 6/1990 |

* cited by examiner

*Primary Examiner* — Raymond W Addie

(74) *Attorney, Agent, or Firm* — Chernoff, Vilhauer, McClung & Stenzel

(57) ABSTRACT

The bridge is constructed of one inner tube and an outer tube surrounding the inner tube. The inner and outer tube are joined to each other by connecting pipes welded to the outer surface of the inner tube and to the inner surface of the outer tube so that the inner tube and the outer tube are connected to each other through said connecting pipes whereby a rigid composite structure is formed. The tubes and pipes are preferably laser welded to each other, preferably by a continuous seam.

13 Claims, 4 Drawing Sheets

ULTRA LIGHT
TUBE BRIDGE

ULTRA LIGHT
CONVEYOR BRIDGE

CROSS SECTION OF
A FOOT FOR A BRIDGE

BRIDGE AND METHOD FOR MANUFACTURING THE BRIDGE

This is a national stage application filed under 35 USC 371 based on International Application No. PCT/FI2006/000218 filed Jun. 20, 2006.

The present invention relates to a method for manufacturing a ultralight steel bridge for forming a passage for materials, electricity and communications lines as well as personnel among others.

The invention relates also to a bridge manufactured by the method.

BACKGROUND OF THE INVENTION

At the moment walking bridges, pipe bridges and conveyor bridges include a supporting frame and walls, floor and roof that cover the frame. Pipes, walking paths, cables and such are located inside the bridge and require further supporting structures that are used for mounting these to the frame of the bridge. Thus the frame has to support all the weight of the covering structures and effective elements as well as their supporting structures, whereby the supporting frame has to be very strong and heavy. A heavy structure further requires a support to the ground or building structures on short spans. Such a heavy structure is slow to build and expensive due to great amount of building material work needed. The cross section of the bridges is typically square, since it is easiest to construct. This leads to large wind surfaces and heavy loads on the bridge due to wind. On snowy environments snow accumulating on the flat roof of the bridge leads to increased stresses and removing of snow during winter may be required. The bridge requires large area on ground or on a floor because of heavy support stands for which typically A-frames are used. This area cannot be effectively used for other purposes because of supports. Overall, the existing bridge structures are very heavy, large and expensive and material costs are high.

SUMMARY OF THE INVENTION

According to the present invention, the bridge is constructed of one inner tube and at least one outer tube surrounding the inner tube, the inner and outer tube being joined to each other by at least one connecting pipe welded to the outer surface of the inner tube and to the inner surface of the outer tube so that the inner tube and the outer tube are connected to each other through said connecting pipe whereby a rigid composite structure is formed.

According to the other aspects of the present invention, the tubes and pipes are laser welded to each other, preferably by a continuous seam. The space between the inner and outer tube preferably comprises of several connecting pipes welded to inner and outer tubes so that a very strong stressed-skin structure is formed. The material of the bridge is preferably stainless or acid-proof steel whereby the bridge is resistant to weather and environmental stresses. The cross section of the tubes is preferably oval.

According to one embodiment of the invention, the bridge is welded together by using continuous seams so that a liquid proof and gas tight space is formed.

Other objects and features of the invention will become apparent from the following detailed description considered in conjunction with the accompanying drawings. It is to be understood, however, that the drawings are intended solely for purposes of illustration and not as a definition of the limits of the invention, for which reference should be made to the appended claims.

THE INVENTION PROVIDES ESSENTIAL BENEFITS

The invention can be utilized for transport of liquid, gaseous and solid materials or as a passing bridge for light traffic. The outer appearance of a bridge having a closed continuous surface is neat. By integrating between the tubes of the bridge thin walled utility pipes used for transport of liquid, gas fog or steam or functioning as pneumatic conveyors for particulate solid matter, an ultra light but extremely rigid construction is achieved. The idea is to used utility pipes as constructional elements instead of carrying their weight by a separate support structure. The net weight of the bridge, i.e. the weight of the material to be transported compared to the gross weight, i.e. to the weight of the bridge together with the material to be transported is exceptionally favorable. Stiffness and rigidity also enable use of long spans between supports of the bridge which reduces the required footprint of the bridge on the ground or floor as well as the amount of the construction material needed. The combination of wide spans and ultra light construction exceptionally large savings can be made in the use of construction materials.

Since the preferred embodiment of the invention is naturally liquid and gas proof, the bridge can be located floating on water or below a water surface. The bridge can also readily be lead through dirty or hazardous spaces since the inside of the bridge is sealed from contamination. The structure withstands over- and underpressure without any further sealing. This is beneficial for sealing dust, gas or like inside or outside the bridge. Same structure can further be used as pipe tunnel or other tunneling under earth surface where it is usually capable of carrying loads caused by the weight of the earth without any further support structures.

The support legs of the bridge may be constructed according to same principle by using at least two skin tubes and adjoining pipes. Such a structure is rigid and stabile, whereby only single leg can be used instead of an A-frame. This leaves far larger footprint free for use under the bridge than the use of A-frames and such. The leg can be used for leading utility pipes as the bridge structure and an emergency exit, stairs or even an elevator can be placed within the inner tube of a leg. This makes the used of available space more efficient and the structure of the leg is much more simple than that of an A-frame.

According to one advantageous embodiment of the invention the cross Section of the bridge is oval. This makes it possible to vary the distance between the inner tube and the outer tube such that pipes of different diameters can be placed between the tubes. Further, the cross section is very advantageous regarding the stiffness of the structure. Since the outer skin of the bridge does not have flat surfaces, its wind resistance is small and turbulences causing vibrations is kept low. By virtue of the curved and smooth roof surface, snow cannot accumulate on the bridge and removal thereof is not needed. This is important regarding maintenance costs of the bridge. Low wind and snow load also lowers the stresses directed to the legs and the legs can be made lighter. Due to smooth and even OUTER surface made of weather resistant material, the bridge can be kept clean simply by washing it with water and possibly detergents. If desired, cleaning of the bridge and be made automatic.

The bridge can be easily provided with heating or cooling simply by adding required piping in the structure. Heat isolation can be made by providing an underpressure between at least two skin tubes of the bridge or the same space can be provided by isolation foam sprayed in the space or any other conventional isolation material. It must be noted that the structure providing closed space within the tubes acts as heat isolation already, even though the steel material used therein causes heat transfer by conduction.

DETAILED DESCRIPTION OF THE PRESENTLY PREFERRED EMBODIMENTS

Figure 1:
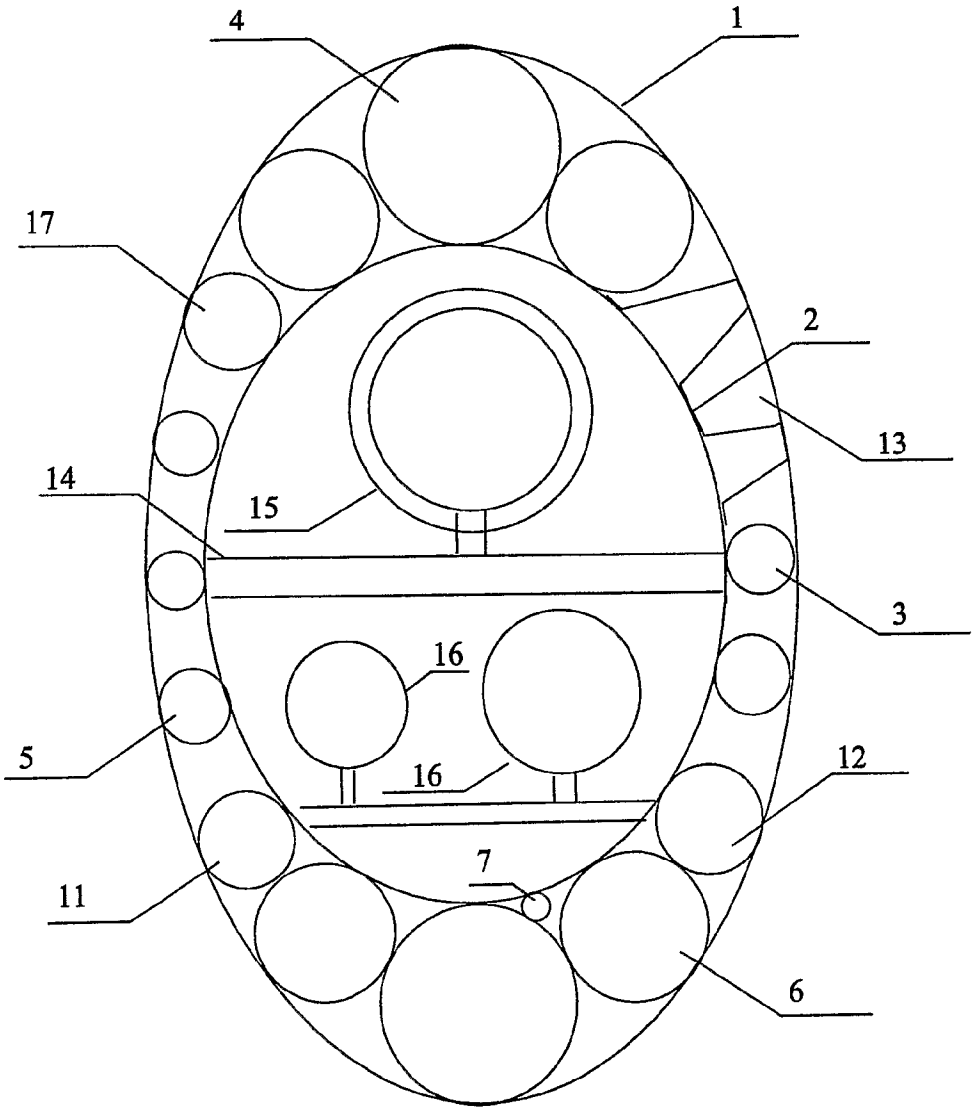
FIG. 1 shows a bridge according to invention, a pipe bridge.

FIG. 1 shows a pipe bridge that comprises an oval outer skin tube 1 and circular inner tube 2. The distance between outer tube 1 and inner tube 2 is thus greater at the tips of the oval than at the sides thereof. This makes it possible to place pipes of different diameters in the space between the inner and outer tube. At the upper part of the pipe bridge wherein the distance between the inner and outer tube is greatest, is placed a integrated gas pipe 4 having a large diameter. The space between the tubes 1, 2 becomes smaller towards the midpoint of the oval of the outer tube 1. Simultaneously the diameter of pipes placed in the space diminishes accordingly. In this embodiment the pipes include liquid pipes 3, air pipes 5, a pneumatic transfer line 6, a channel for automation cables 11, a channel for electric cables 12 and pipe for removal of condensed water 9 and finally, integrated process pipes 17. Further, a space 13 is formed between the inner and outer tube for a maintenance or entering/exit door. The space inside the inner tube 2 is divided by a primary support beam 14 on which is mounted a heat insulated hot tube 15. Under the primary support beam there is space for various separate pipes 16.

The pipes shown in the embodiment of FIG. 1 are only examples of what kind of utility pipes can be installed within the bridge structure. The load bearing structure is mainly composed of inner and outer skin and the pipes therebetween. These pipes and tubes form a stressed skin structure that is very rigid and can take large loads compared to the thicknesses of the materials used. The thickness of the skin tubes 1, 2 can be preferably 0,5-2 mm but even thicknesses up to 4 mm can be used. It is recommended that such a material thickness is chosen that is readily available as standard thickness from material manufacturers. This aids in keeping the costs of the structure low. The utility pipes within the bridge have to be dimensioned according to requirements of their initial use. However, their strength is normally more than adequate for use as a construction element of the bridge when the bridge is designed according to the invention. When the elements of the bridge are combined as shown here, the combined strength of the structure becomes far greater than the rigidity and strength of each element counted together.

Figure 2:
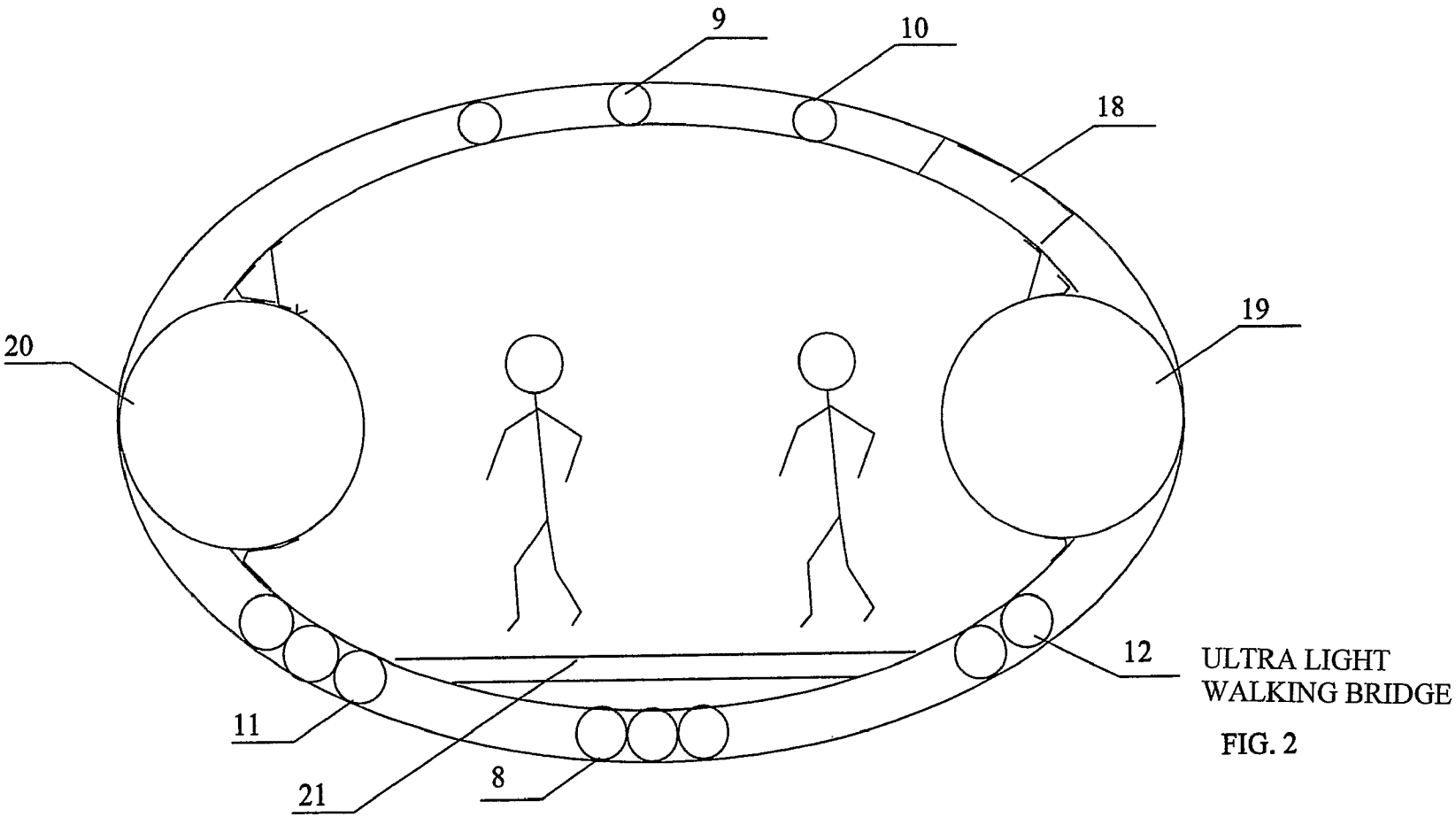
FIG. 2 shows a second bridge according to invention, a conveyor bridge.

FIG. 2 depicts a walking bridge having an oval cross section in both the inner and outer tube 1, 2. Thus the distance between the skins is the same all around the tubes. In this example a sprinkler pipe 9, light cable pipe having light holes into the inner space of the inner tube 2, a window element 18, sewage pipes 8 for the tunnel and automation an electric cable pipes are placed between the tubes. At the tips of the oval shape there are channels for incoming air 19 and exit air 20, The diameter of the pipes forming these channels 19, 20 is greater than the distance between the inner and outer tube whereby they reach inside the inner tube and the inner tube is attached to these pipes 19, 20. The inner tube is in this embodiment made of two sheet metal sections that are worked to curved convex shape and welded on air pipes 19, 20. A walking bridge 21 is formed inside the inner tube.

Figure 3:
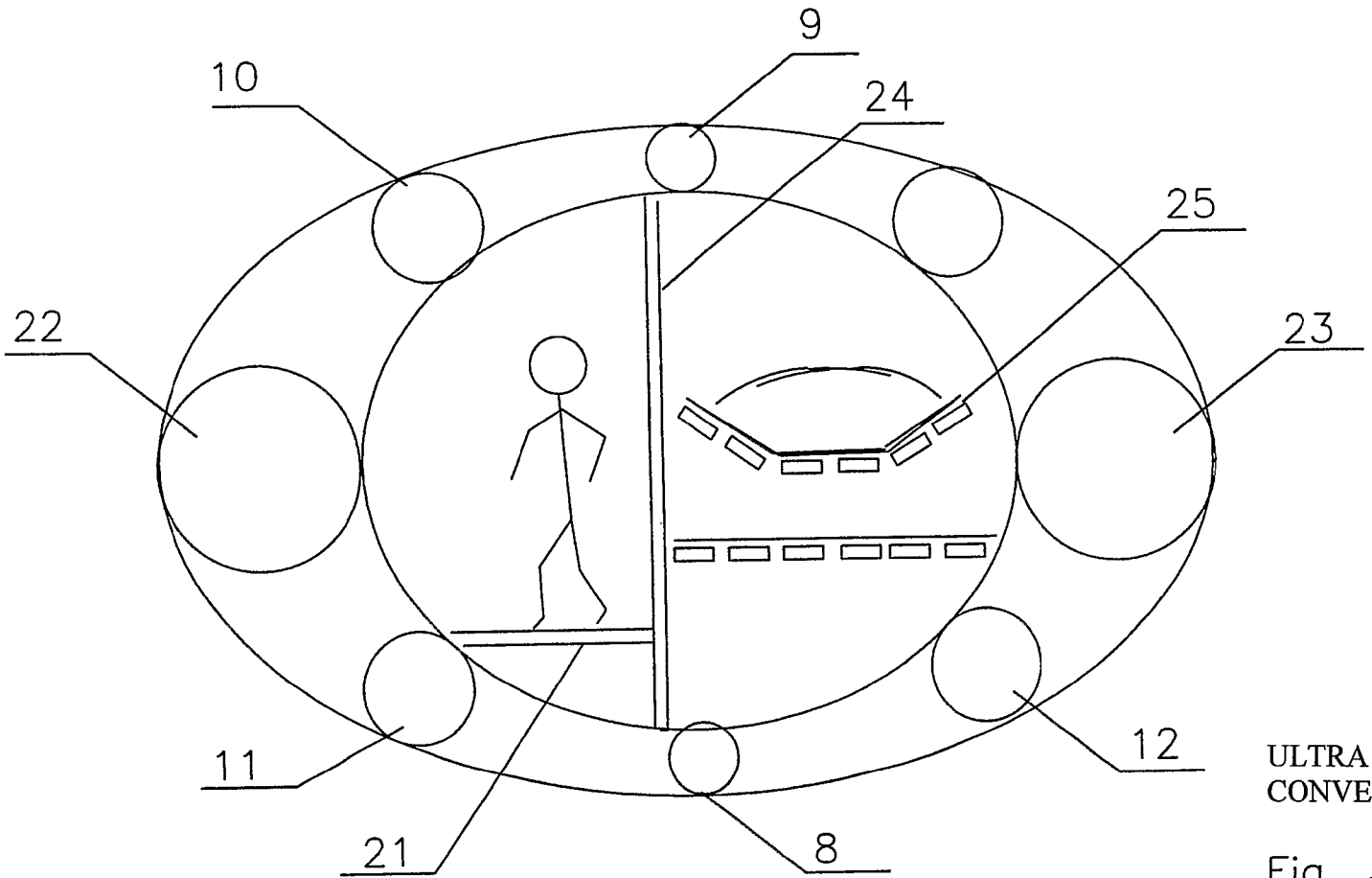
FIG. 3 shows a third bridge according to invention, a walking bridge.

The conveyor bridge according to the FIG. 3 again utilizes a combination if an oval outer tube 1 and round inner tube 2. The largest pipes i.e. a dust removal pipe 22 and heating pipe 23 travel on the sides of the bridge wherein there is grates distance between the skin tubes. In addition thereto, a sewage pipe 8 for the bridge, a sprinkler pipe 9, a light cable pipe 10 and installation pipes 11, 12 for automation and electric cables travel between the skin tubes 1, 2. The space within the inner tube is divided by a dividing wall 24 on one side of which is a walking bridge and on the second side a belt conveyor. The conveyor of this embodiment or of any other embodiment of the invention may be of any desired type, for example a belt conveyor, chain conveyor, scraper conveyor, a pneumatic conveyor or a conveyor track.

Since the bridges used in industry and elsewhere are quite long in many cases, length vary in great extent according to the temperature. In order to compensate this, a bellows structures may be used. Normally used known bellows types are usable with the invention also. Crossings or branchings can be of T- X- or any other type. One possible way to form a crossing point is to use a ball shaped crossing element that can be made as a similar stressed skin structure as the invention. Since the bridge is normally made of segments having definite length, the segments have to be joined together. This can be done either by bellows or by joining flanges attached to the ends of the bridge segments.

Figure 4:
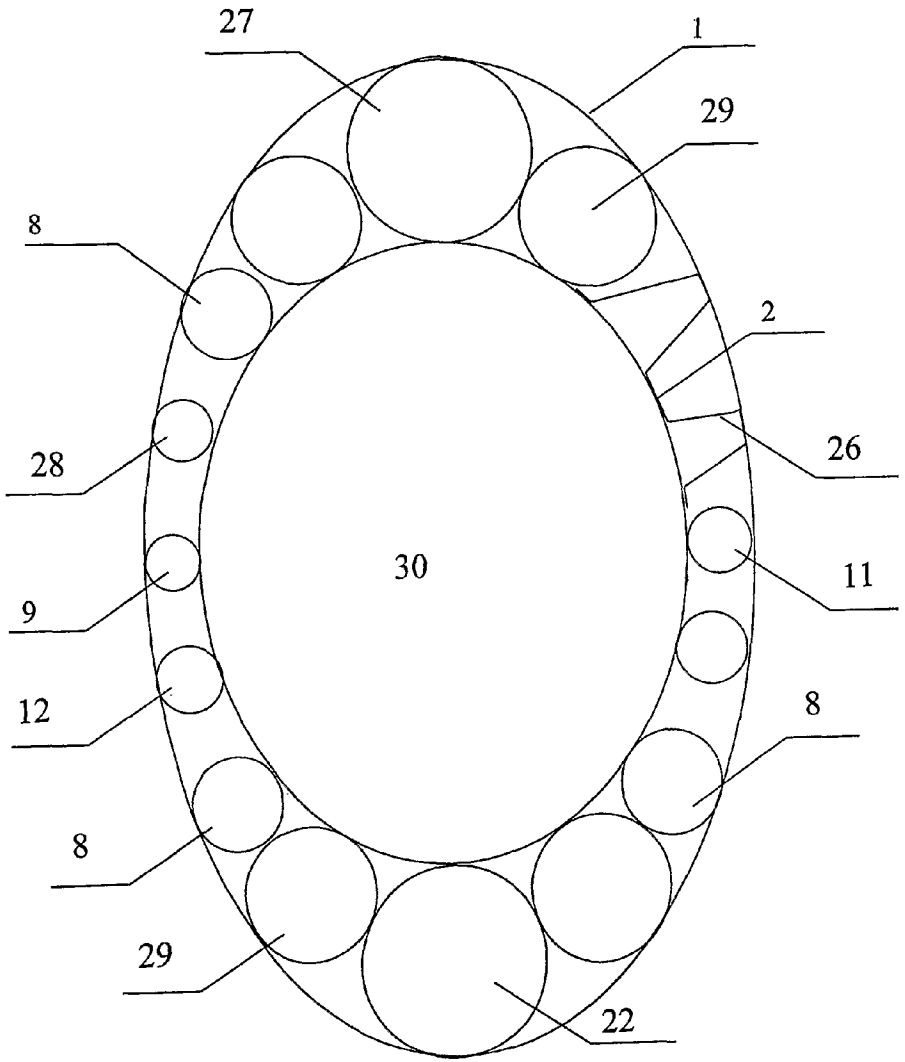
FIG. 4 shows an embodiment of a bridge foot according to the invention.

FIG. 4 shows one embodiment of a leg that can be used for supporting the bridge according to the invention. Basically, the leg is structurally similar to a bridge segment, it is only positioned in upright position. The leg of FIG. 1 comprises a combination of a circular inner tube 2 and an oval outer tube 1. The utility pipes placed within the leg between the inner and outer tube consist mainly of same pipes as used in bridge. The number and type of the pipes is determined by the field of use of the bridge and the leg, naturally. The utility pipes include pipes for automation—and electric cables 11, 12, sewage pipes 8, pipes for sprinkler water 9 and for further fire extinction water 28, for heating air 27, for dust removal 22 and ventilation 29 of the leg shaft 30. The leg shaft is formed by the inner space of the inner tube 2 and can be provided with ladders stairs or an elevator for entering and exiting the bridge that is supported by the leg. If needed, the leg can be further stiffened by web-like stiffeners 26.

Oval and circular cross sections are preferred for outer and inner tubes. Basically, these can be made of angular cross section such as quadrangular, pentagonal, hexagonal or like. However, the corner edges form stressed points in these shapes and the straight flat surface are more susceptible to buckling than curved surfaces. Therefore these shapes do not necessarily give same strength for same material thicknesses as the continuously curved shapes like oval and circle. These forms are also effected more by wind and snow loads. One preferable embodiment might be to form the cross section partly oval and partly circular, for example so that the upper part of the tube is ovally curved and the lower part curcular.

The bridge or a leg is manufactured as follows:

First, the inner tube 1 is formed. This can be done by curving a flat sheet of metal on a desired curvature and by welding the edges together. Since laser welding is used in later manufacturing stages, it is reasonable to use laser welding in this step also. However, any other welding method may be used herein if desired. The diameter or dimensions of an ovally shaped tube can be quite large in a bridge structure, whereby it may be advisable to make the tube of several segments that are welded together. In second manufacturing stage the utility pipes are welded to the outer surface of the inner tube by laser welding. Laser welding is used herein since it is capable to forming a seam between metal sheets when the welding is performed through one of the sheets. Here the welding is done from the inside of the inner tube. In laser welding, it is preferable to use continuous seam. This also provides a seam that is liquid and gas tight whereby the whole structure becomes tight. When desired amount of utility pipes are welded on the inner tube, the second (outer) tube 1 can be worked from metal sheet or sheets and welded over the utility pipes. The outer tube is welded from outside the skin of the outer tube to the utility pipes. Also herein laser welding is used as well as continuous seam. A discontinuous seam can be used if desired for some reason, but in laser welding it does not provide any savings in energy or material. The outer tube is also preferably made of segments that can be on the utility pipes one by one and the edges are sealed by welding when the segments are in place. Of course it is quite as possible to manufacture the outer tube separately and pass the tube over the utility pipes longitudinally. If the dimensions of the inner tube are small, it can be made of ready made steel tube having large enough diameter. Such a tubes are usually welded tubes whereby at least one seam is formed on the inner tube in this case also.

The essential feature of the manufacture is laser welding of the tubes to the utility pipes, first from the inside of the inner tube and second from the outside of the outer tube. The seam is preferably continuous.

The above described construction examples and description of manufacture show only elements having two tubes or skin cores. It is quite possible to use three, four or even more coaxial tubes for making a multicore bridge structure. For example, a third tube can be added in order to form heat insulation over the bridge where the insulation is between the middle and the outer tube.

Thus, while there have been shown and described and pointed out fundamental novel features of the invention as applied to a preferred embodiment thereof, it will be understood that various omissions and substitutions and changes in the form and details of the de . . . may be made by those skilled in the art without departing from the spirit of the invention. For example, it is expressly intended that all combinations of those elements and/or method steps which perform substantially the same results are within the scope of the invention. Substitutions of the elements from one described embodiment to another are also fully intended and contemplated. It is also to be understood that the drawings are not necessarily drawn to scale but they are merely conceptual in nature. It is the intention, therefore, to be limited only as indicated by the scope of the claims appended hereto.

What is claimed is:

1. Method for manufacturing a bridge, comprising steps of providing a first tube having a first cross section and first dimensions of the cross section, providing at least one utility pipe, and providing a second tube having a larger cross section and dimensions as the first cross section and dimensions, welding the at least one utility pipe lengthwise on the outer surface of the first tube by laser from the inside of the first tube, and welding the second tube over the at least one utility pipe by laser from the outside of the second tube.

2. A method according to claim 1, comprising performing the welding by using continuous seam.

3. A method according to claim 1, comprising forming at least one of the tubes by working from at least one segment of sheet metal and welding the edges of sheet together to form a tube.

4. A method according to claim 3, comprising forming at least one tube of several segments of sheet metal.

5. A method according to claim 1, comprising making at least one tube that has a continuously curved cross section like oval or circle.

6. A method according to claim 1, comprising making at least one tube that has an oval cross section and at least one having a circular cross section.

7. A bridge having essentially closed structure, comprising an inner tube having first cross section and dimensions of cross section, at least one outer tube having second cross section and dimensions and surrounding the inner tube, and at least one utility pipe, at least one of the tubes being formed of sheet metal and comprising a seam that joins at least two edges of the sheet metal, wherein the inner and outer tubes are joined to each other by the at least one utility pipe welded to the outer surface of the inner tube and to the inner surface of the outer tube so that the inner tube and the outer tube are connected to each other through said utility pipe whereby a rigid composite structure is formed.

8. A bridge according to claim 7, wherein the at least one utility pipe is welded to the outer surface of the inner tube by laser welding from inside of the inner tube and on the inner surface of the outer tube by laser welding from the outside of the outer tube.

9. A bridge according to claim 7, wherein at least one of the tubes has a continuously curved cross section like oval or circle.

10. A bridge according to claim 7, wherein at least one of the tubes has an oval cross section and one of the tubes has an circular cross section and at least two utility pipes having different diameter are placed in the space between the tubes.

11. A bridge according to claim 7, wherein at least the tubes are made of stainless or acid-proof steel.

12. A bridge according to claim 7, wherein at least one of the tubes is made of several sections of sheet metal.

13. A bridge according to claim 7, characterized of comprising at least one leg having the similar structure as the bridge and comprising at least one inner tube and one outer tube that are joined together by at least one utility pipe.

* * * * *